US010227864B2

(12) United States Patent
Donderici et al.

(10) Patent No.: US 10,227,864 B2
(45) Date of Patent: Mar. 12, 2019

(54) MAGNETIC MONOPOLE RANGING SYSTEM AND METHODOLOGY

(71) Applicant: Halliburton Energy Services, Inc., Houston, TX (US)

(72) Inventors: Burkay Donderici, Houston, TX (US); Baris Guner, Kingwood, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 239 days.

(21) Appl. No.: 15/036,408

(22) PCT Filed: Dec. 12, 2013

(86) PCT No.: PCT/US2013/074540
§ 371 (c)(1),
(2) Date: May 12, 2016

(87) PCT Pub. No.: WO2015/088528
PCT Pub. Date: Jun. 18, 2015

(65) Prior Publication Data

US 2016/0298444 A1 Oct. 13, 2016

(51) Int. Cl.

| | |
|---|---|
| ***E21B 47/0228*** | (2012.01) |
| ***E21B 47/024*** | (2006.01) |
| ***E21B 47/09*** | (2012.01) |
| ***E21B 47/12*** | (2012.01) |

(Continued)

(52) U.S. Cl.
CPC ..... *E21B 47/024* (2013.01); *E21B 7/04* (2013.01); *E21B 47/02216* (2013.01); *E21B 47/0905* (2013.01); *E21B 47/122* (2013.01)

(58) Field of Classification Search
CPC .... E21B 47/024; E21B 7/04; E21B 47/02216; E21B 43/2406; E21B 47/122; E21B 47/0905; E21B 49/00
See application file for complete search history.

(56) References Cited

U.S. PATENT DOCUMENTS

| | | | | |
|---|---|---|---|---|
| 3,315,264 | A | 4/1967 | Ancona et al. | |
| 4,458,767 | A * | 7/1984 | Hoehn, Jr. ..... | E21B 7/04 166/255.1 |
| 5,144,590 | A | 9/1992 | Chon | |

(Continued)

FOREIGN PATENT DOCUMENTS

| | | |
|---|---|---|
| RU | 95111057 A1 | 6/1997 |
| RU | 2184384 C1 | 6/2002 |

OTHER PUBLICATIONS

Office Action issued in related RU Application No. 2016114393, dated Jun. 7, 2017 (6 pages).

(Continued)

*Primary Examiner* — Brad Harcourt
(74) *Attorney, Agent, or Firm* — Alan Bryson; Baker Botts L.L.P.

(57) ABSTRACT

An example method for downhole operations using a magnetic monopole includes positioning at least one of a transmitter and a receiver within a first borehole. At least one of the transmitter and the receiver may be a magnetic monopole. The transmitter may generate a first magnetic field, and the receiver may measure a signal corresponding to the first magnetic field. A control unit communicably coupled to the receiver may determine at least one characteristic using the received signal.

32 Claims, 16 Drawing Sheets

(51) Int. Cl.
*E21B 7/04* (2006.01)
*E21B 47/022* (2012.01)

(56) References Cited

U.S. PATENT DOCUMENTS

| | | | | |
|---|---|---|---|---|
| 5,485,089 | A * | 1/1996 | Kuckes | E21B 47/02216 175/45 |
| 6,175,536 | B1 | 1/2001 | Khan | |
| 7,463,027 | B2 | 12/2008 | Prammer et al. | |
| 7,733,086 | B2 | 6/2010 | Prammer et al. | |
| 2002/0000808 | A1 * | 1/2002 | Nichols | G01V 3/28 324/339 |
| 2003/0014873 | A1 * | 1/2003 | Towle | E21B 7/06 33/304 |
| 2005/0030021 | A1 | 2/2005 | Prammer et al. | |
| 2010/0219819 | A1 | 9/2010 | Kimura et al. | |
| 2011/0030109 | A1 | 2/2011 | Saito | |
| 2011/0139507 | A1 | 6/2011 | Krueger et al. | |

OTHER PUBLICATIONS

International Preliminary Report on Patentability issued in related Application No. PCT/US2013/074540, dated Jun. 23, 2016 (13 pages).

Cheng, David Keun. Field and wave electromagnetics. vol. 2. New York: Addison-Wesley, 1989.

Jones, Douglas L., Gus L. Hoehn, and Arthur F. Kuckes. "Improved magnetic model for determination of range and direction to a blowout well." SPE Paper 14388, SPE Drilling Engineering 2.04 (1987): 316-322.

International Search Report and Written Opinion issued in related PCT Application No. PCT/US2013/074540 dated Sep. 12, 2014, 16 pages.

* cited by examiner

MAGNETIC MONOPOLE RANGING SYSTEM AND METHODOLOGY

CROSS-REFERENCE TO RELATED APPLICATION

The present application is a U.S. National Stage Application of International Application No. PCT/US2013/074540 filed Dec. 12, 2013, which is incorporated herein by reference in its entirety for all purposes.

BACKGROUND

The present disclosure relates generally to oil field exploration and, more particularly, to a magnetic monopole positioning and ranging system and methodology.

In the traditional induction tools used in oil field exploration, coil type antennas are used to transmit and receive electromagnetic signals. Typically, these coil type antennas have included magnetic dipoles. Each of the antenna types may radiate an electromagnetic field with a different radiation pattern. The radiation patterns may limit the effectiveness of the tools to certain downhole applications in certain formation types.

FIGURES

Some specific exemplary embodiments of the disclosure may be understood by referring, in part, to the following description and the accompanying drawings.

Figure 3A:
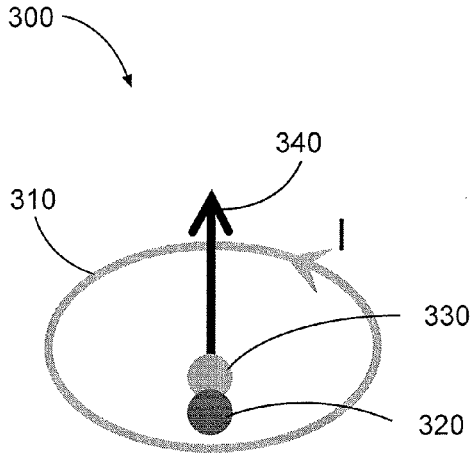
Figure 3B:
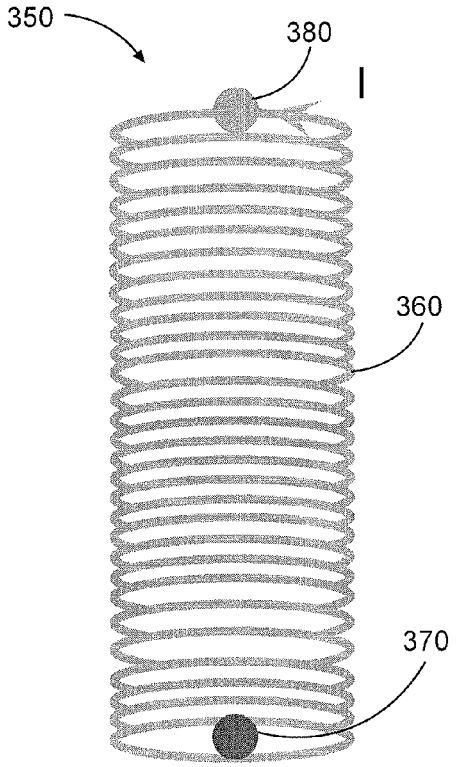

FIGS. 3A-B are diagrams illustrating the difference between a magnetic monopole element and a magnetic dipole element, according to aspects of the present disclosure.

Figure 4A:
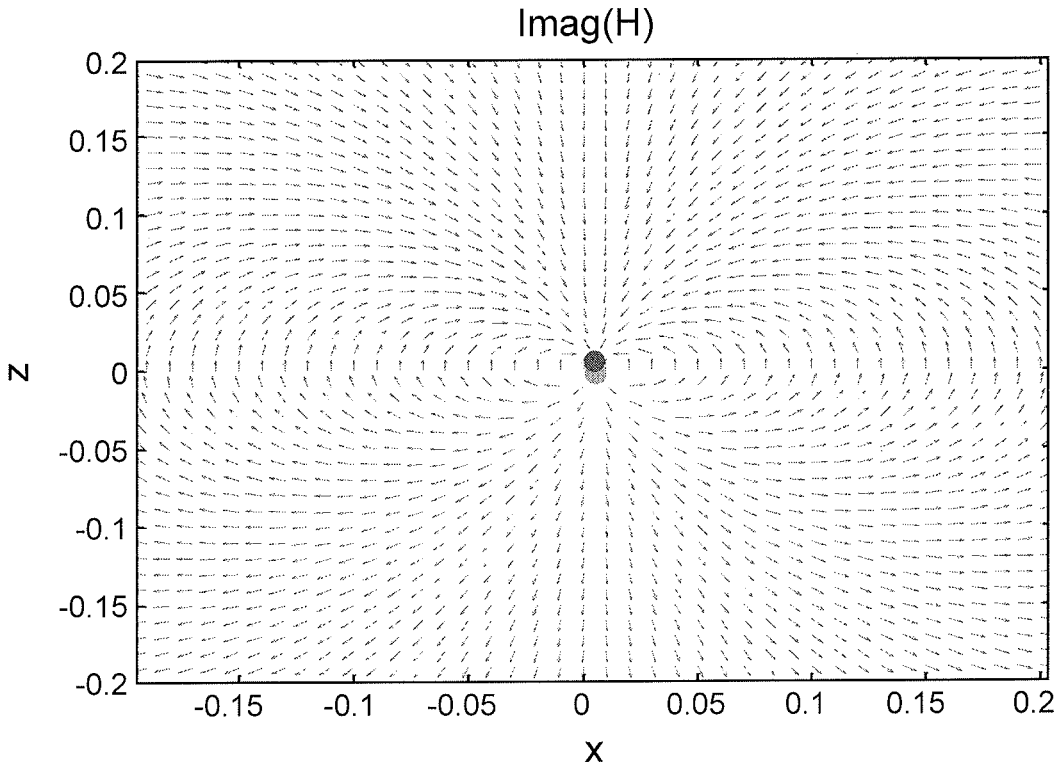
Figure 4B:
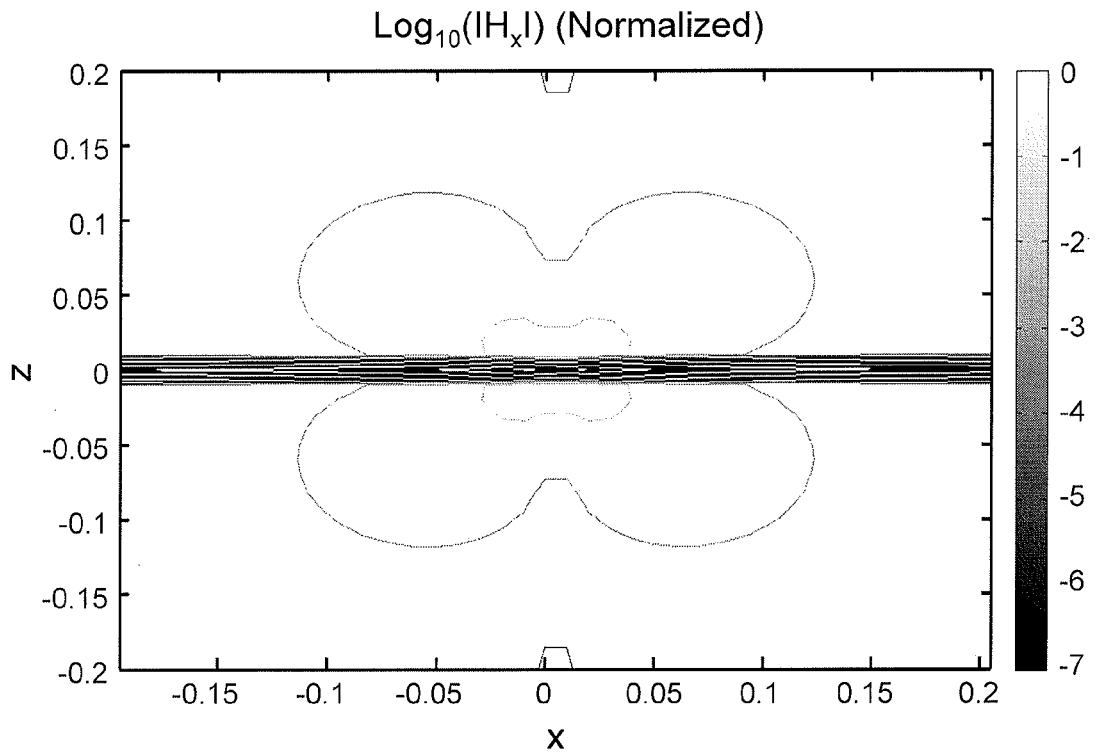
Figure 4C:
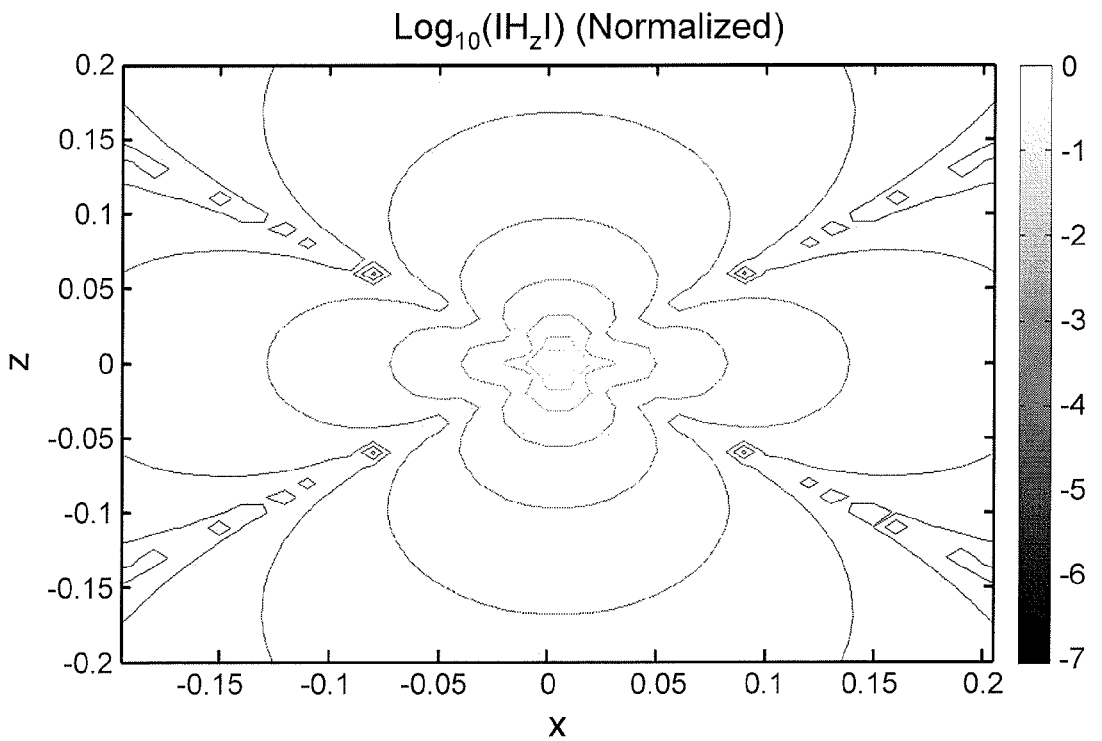

FIGS. 4A-C are charts that illustrate the magnetic field direction and field strength contour lines for an infinitesimal magnetic dipole oriented in z-direction.

Figure 5A:
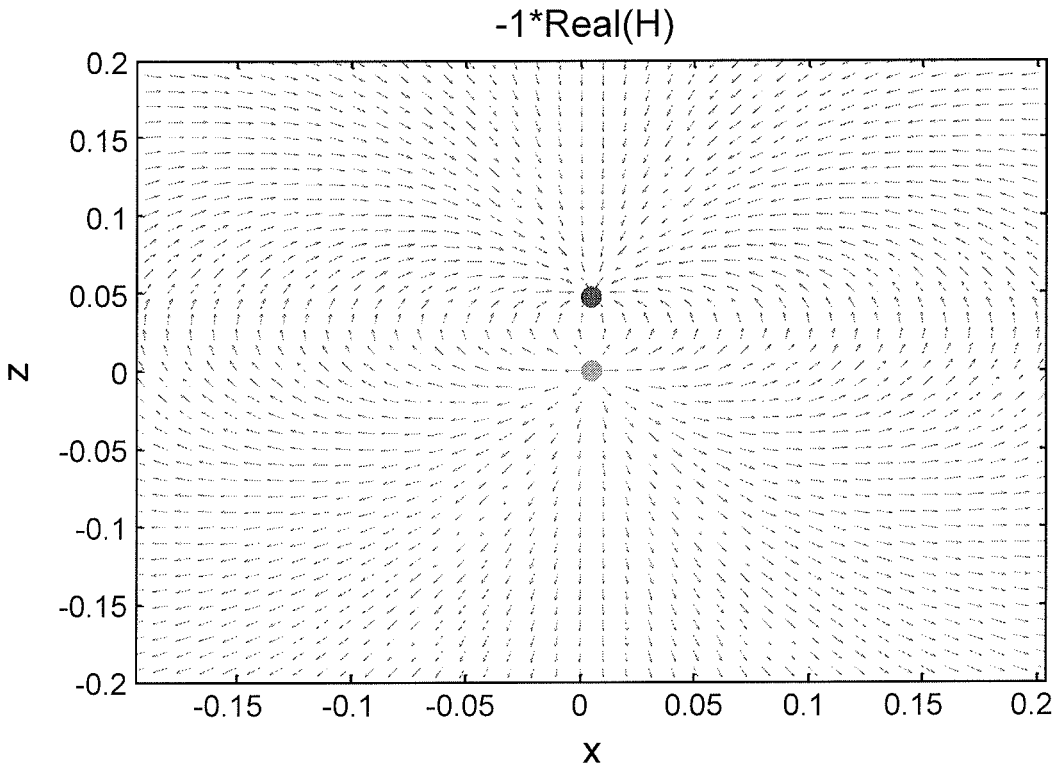
Figure 5B:
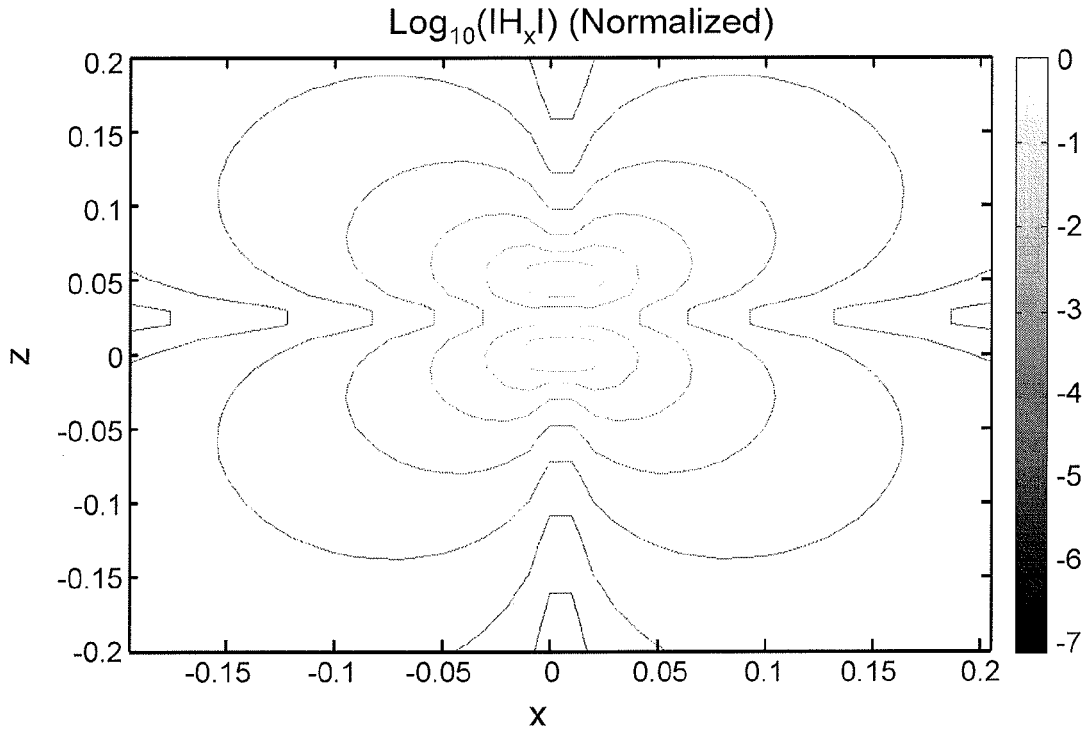
Figure 5C:
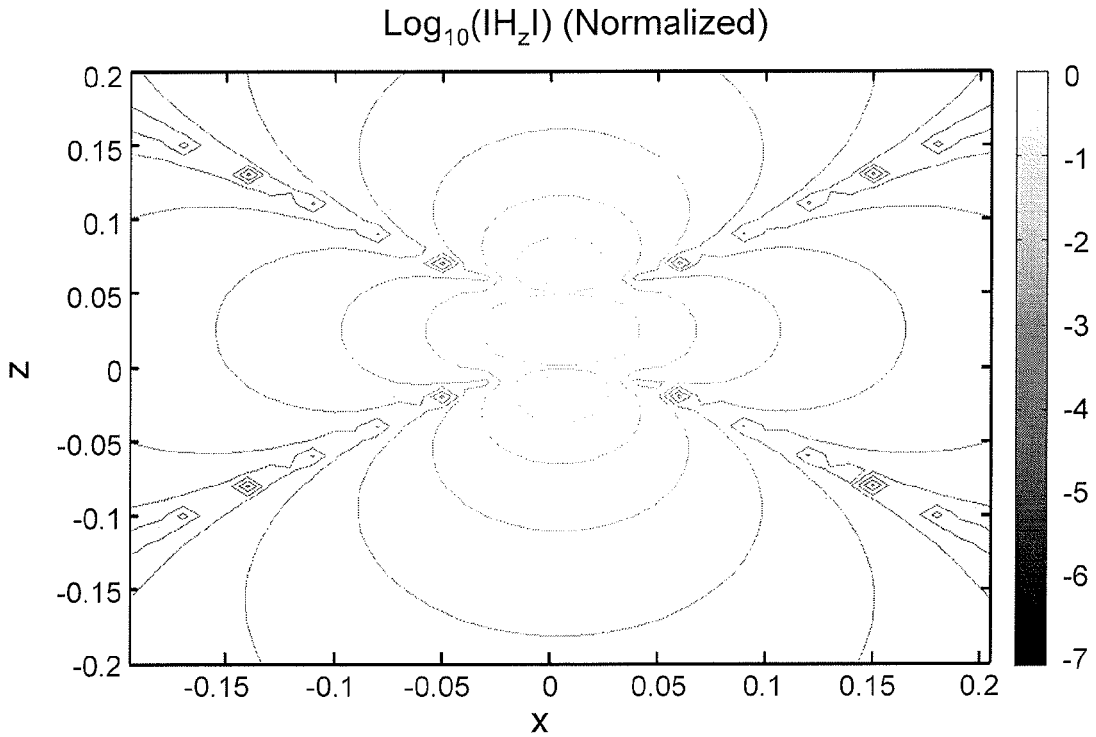

FIGS. 5A-C are charts that illustrate the magnetic field direction and field strength contour lines for a finite length magnetic dipole.

Figure 6A:
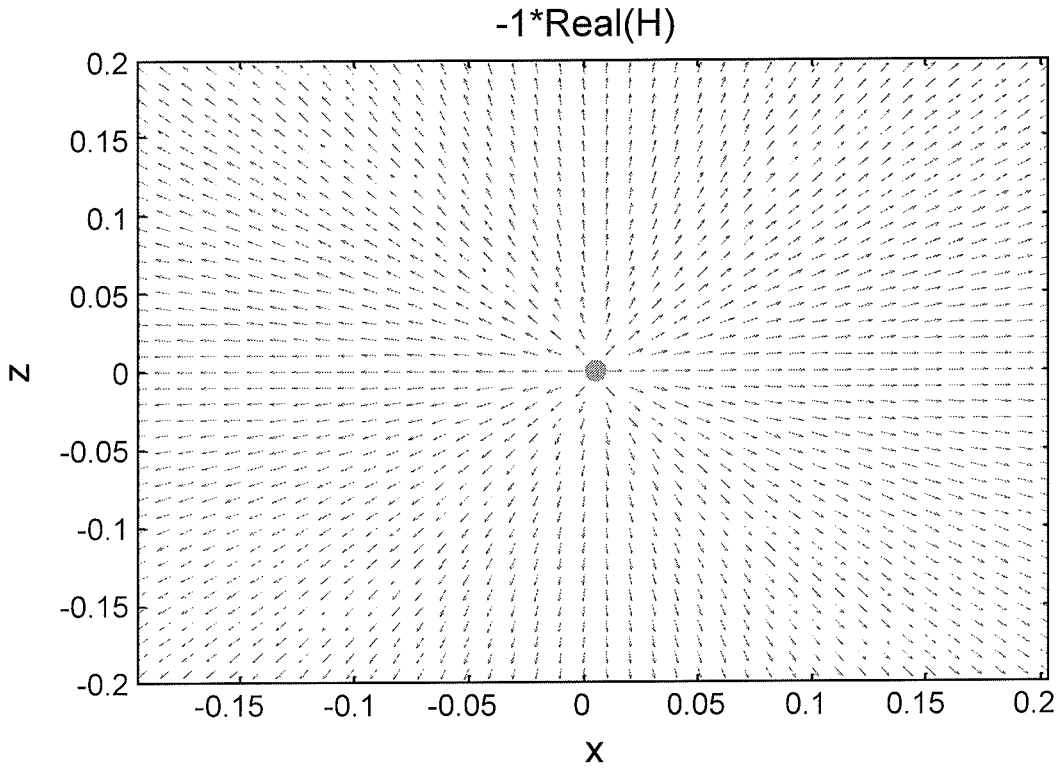
Figure 6B:
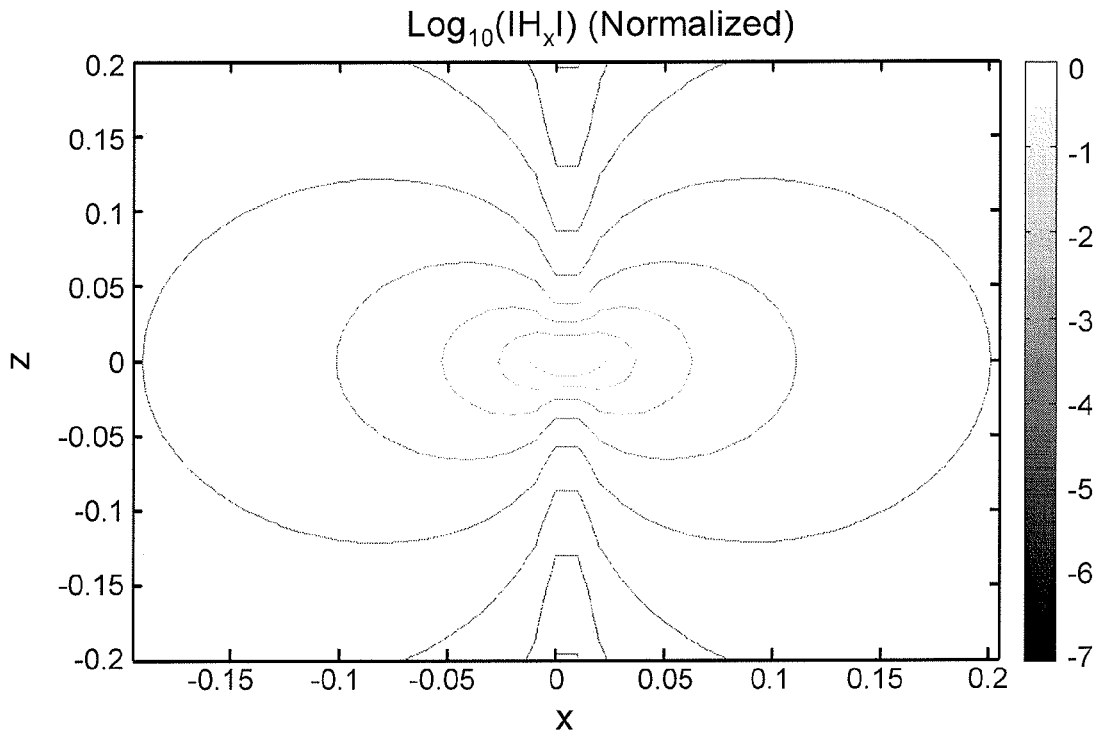
Figure 6C:
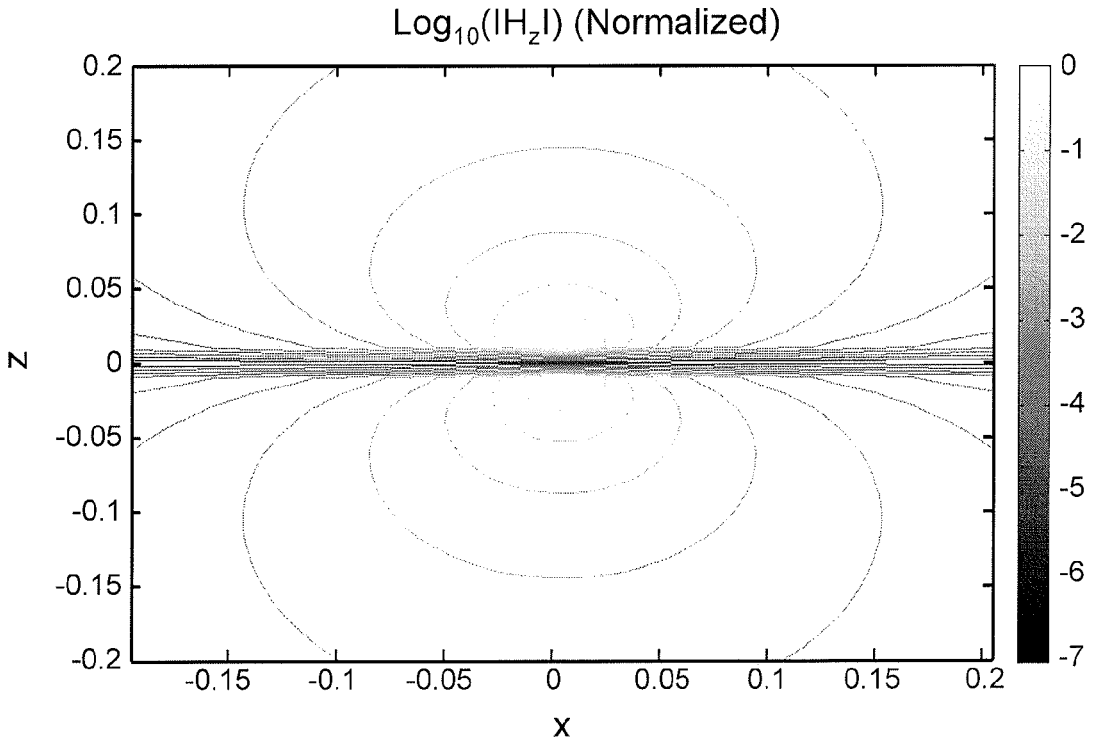

FIGS. 6A-C are charts that illustrate the magnetic field direction and field strength contour lines for a magnetic monopole, according to aspects of the present disclosure.

Figure 7:
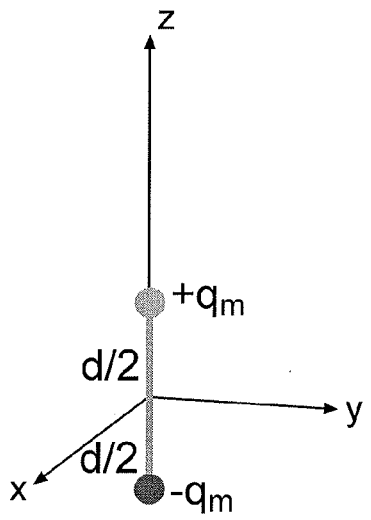

FIG. 7 is a diagram that illustrates two isolated magnetic poles, according to aspects of the present disclosure.

Figure 8A:
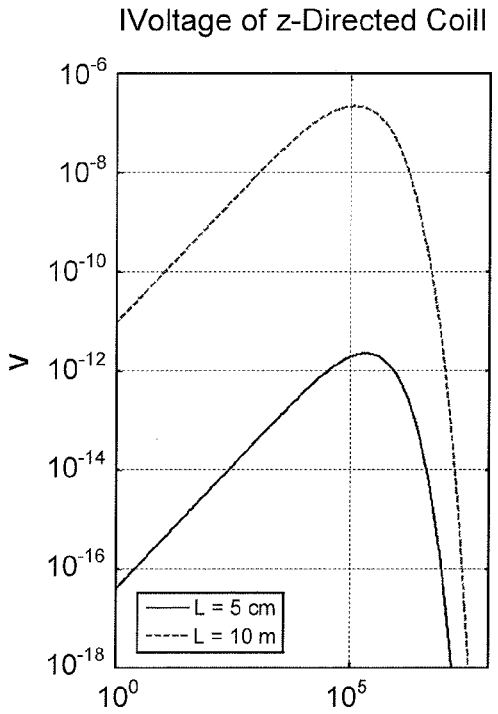
Figure 8B:
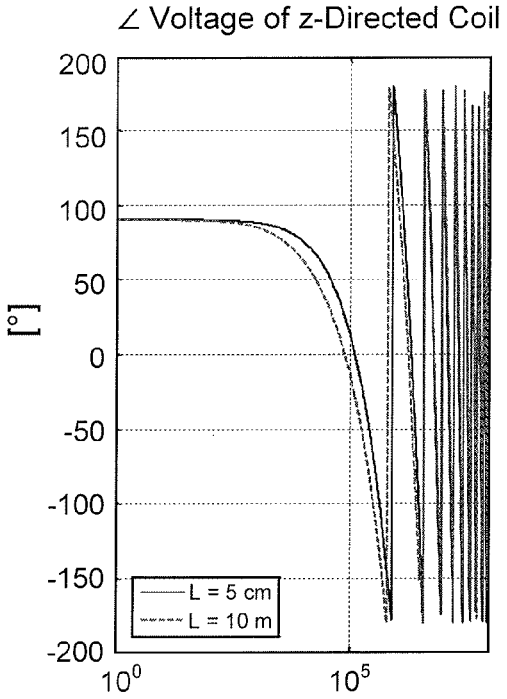

FIGS. 8A-B are charts that illustrate the voltage and frequency responses caused by a magnetic monopole antenna compared to a magnetic dipole antenna, according to aspects of the present disclosure.

Figure 9:
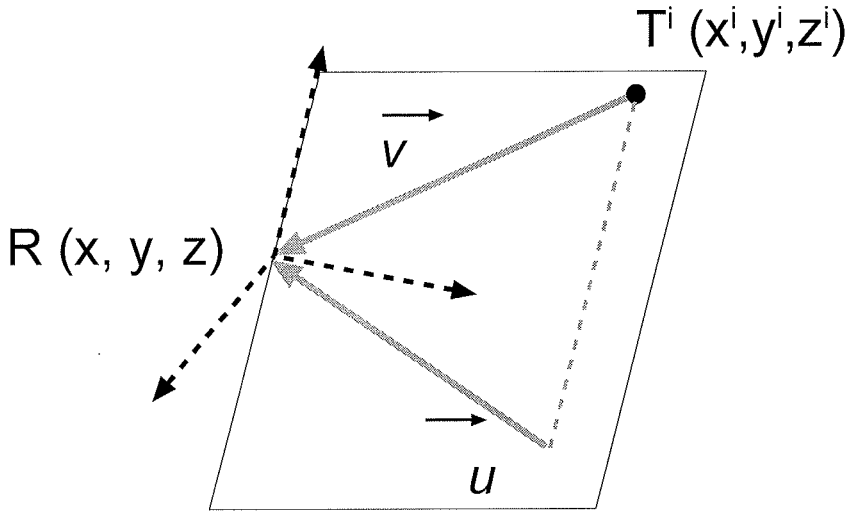

FIG. 9 is a diagram that illustrates a monopole magnetic field measured by a biaxial receiver, according to aspects of the present disclosure.

Figure 10:
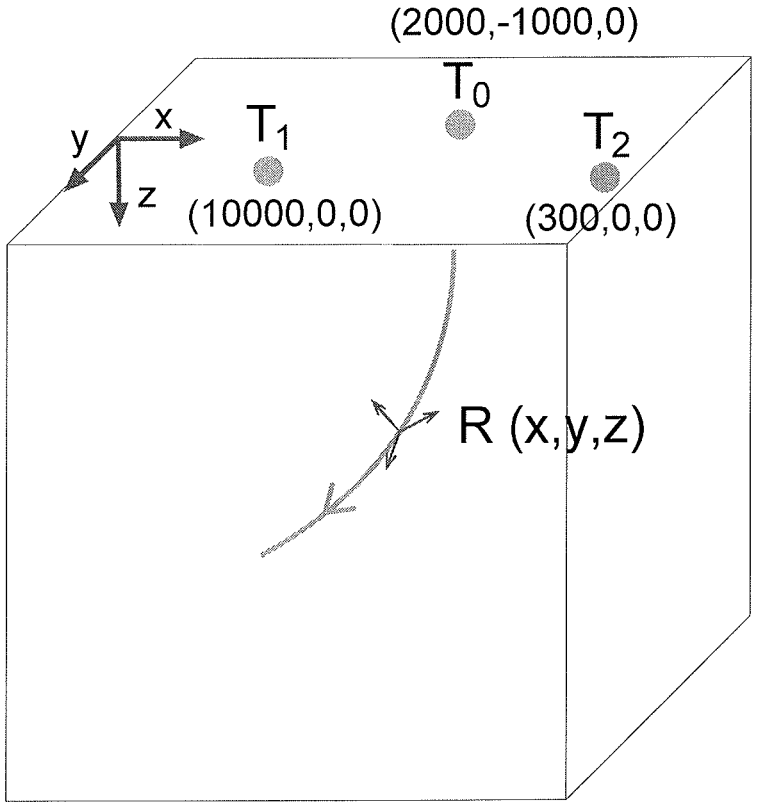

FIG. 10 is a diagram illustrating an example positioning system, according to aspects of the present disclosure.

FIGS. 11A-F are charts that illustrate the results of an example positioning simulation with synthetic data, according to aspects of the present disclosure.

Figure 12:
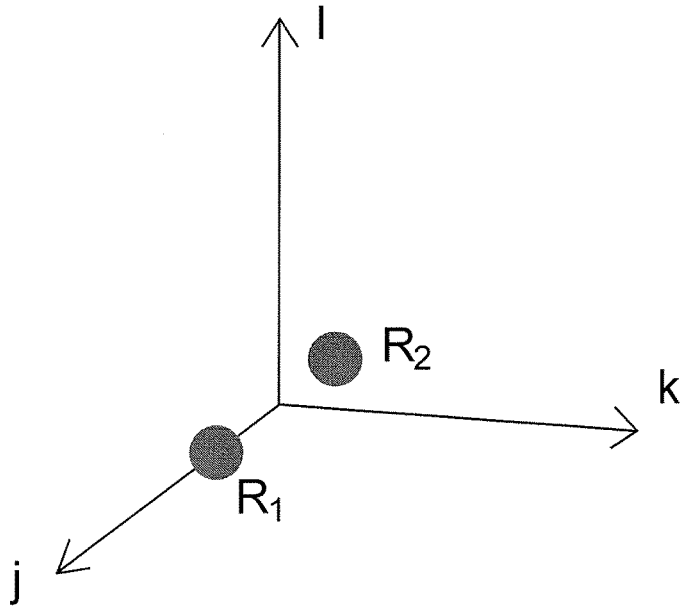
Figure 13A:
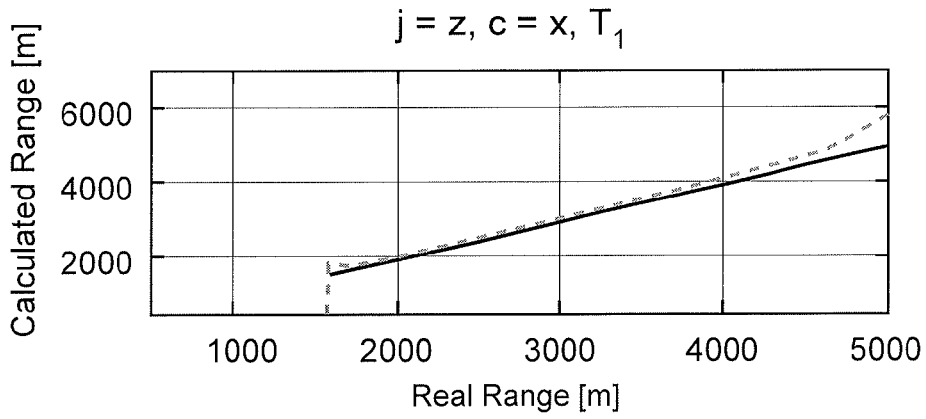
Figure 13B:
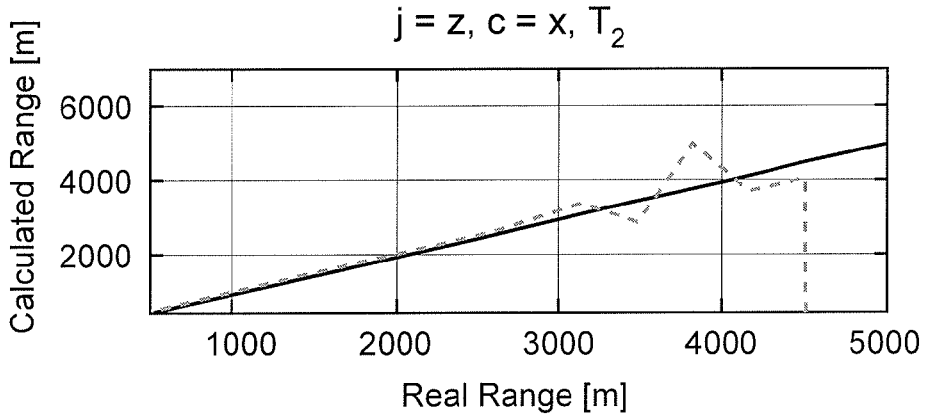
Figure 13C:
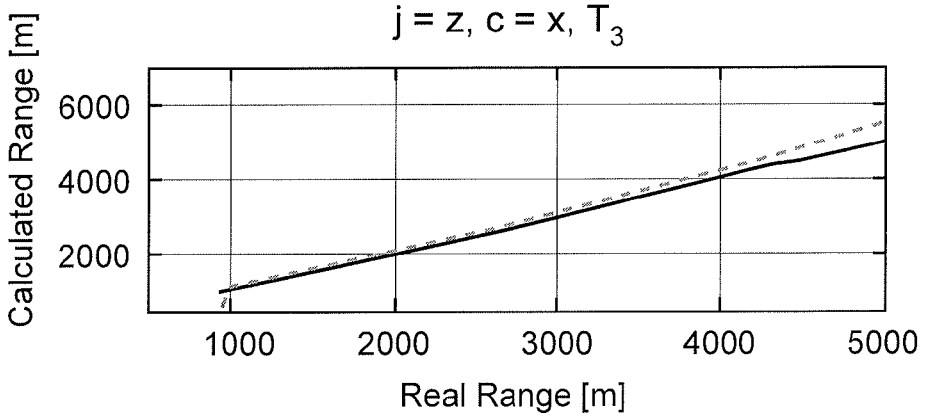
Figure 13D:
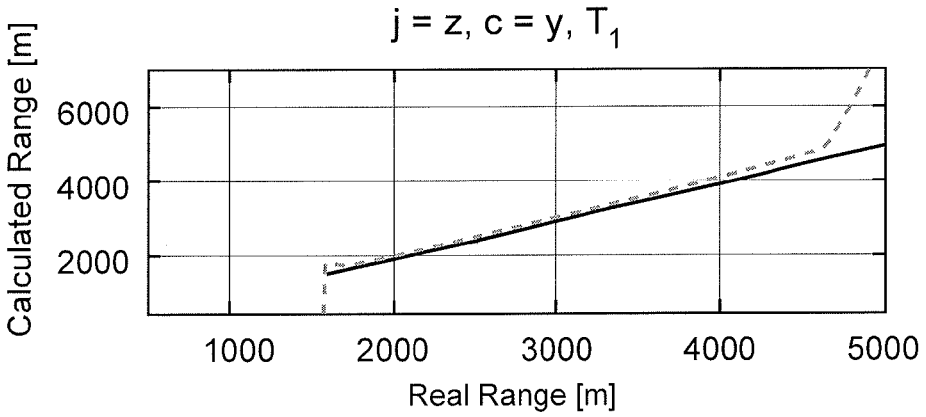
Figure 13E:
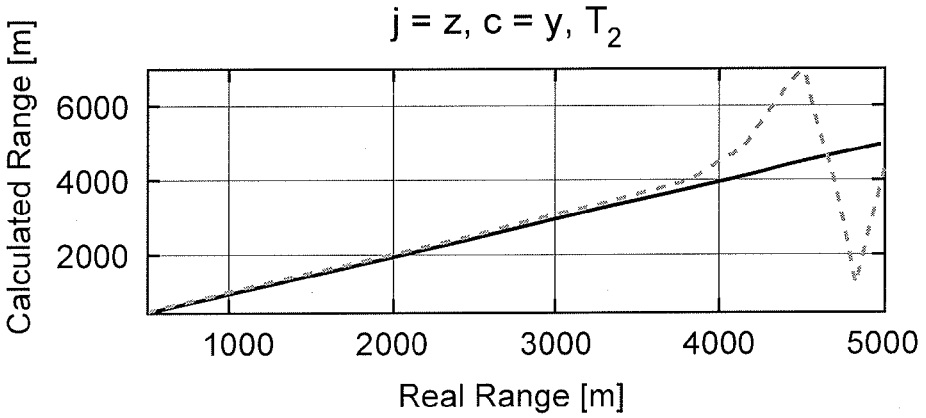
Figure 13F:
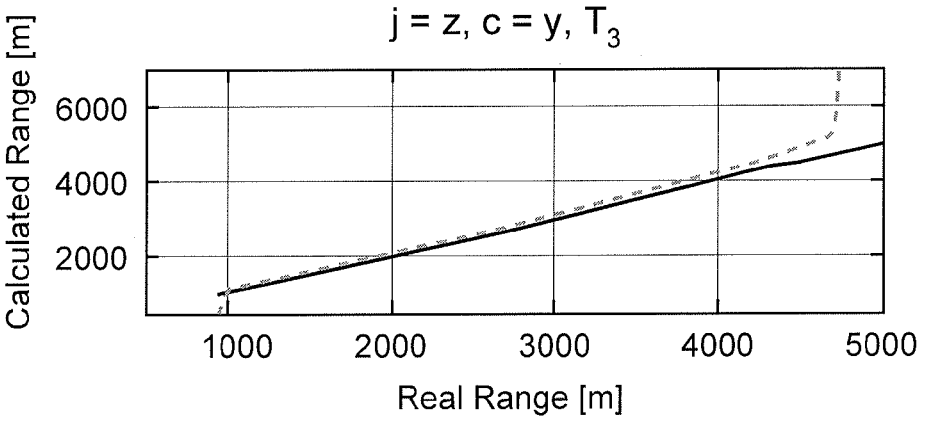

FIG. 12 is a diagram that illustrates example receivers $R_1$ and $R_2$ for the derivative operation, according to aspects of the present disclosure.

FIGS. 13A-F are charts that illustrate the results of an example ranging simulation with synthetic data, according to aspects of the present disclosure.

Figure 14:
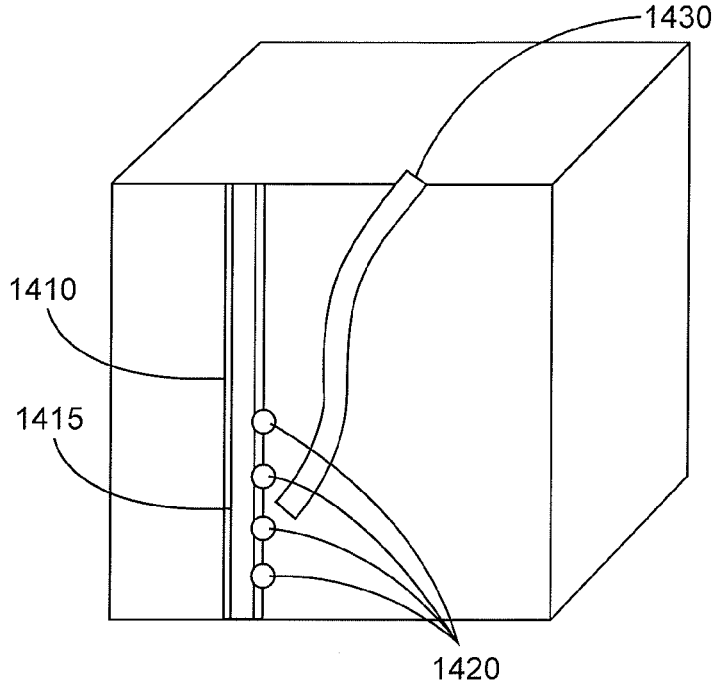

FIG. 14 is a diagram of an example drilling system utilizing magnetic monopoles, according to aspects of the present disclosure.

Figure 15:
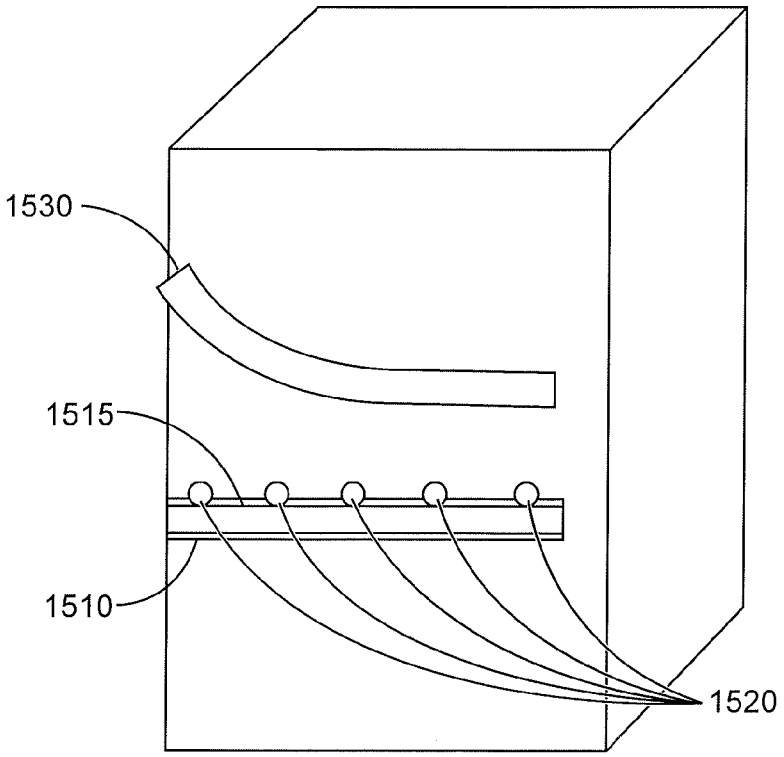

FIG. 15 is a diagram of an example drilling system utilizing magnetic monopoles, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. It may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Illustrative embodiments of the present disclosure are described in detail herein. In the interest of clarity, not all features of an actual implementation may be described in this specification. It will of course be appreciated that in the development of any such actual embodiment, numerous implementation specific decisions must be made to achieve the specific implementation goals, which will vary from one implementation to another. Moreover, it will be appreciated that such a development effort might be complex and time consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to target (such as to an adjacent well) following, target intersecting, target locating, well twining such as in SAGD (steam assist gravity drainage) well structures, relief wells for blowout wells, river crossing, construction tunneling, horizontal, vertical, deviated, multilateral, u-tube connection, intersection, bypass (drill around a mid-depth stuck fish and back into the well below), or otherwise nonlinear wellbores in any type of subterranean formation. Embodiments may be applicable to injection wells, and production wells, including natural resource production wells such as hydrogen sulfide, hydrocarbons or geothermal wells; as well as borehole construction for river crossing tunneling and other such tunneling boreholes for near surface construction purposes or borehole u-tube pipelines used for the transportation of fluids such as hydrocarbons. Embodiments described below with respect to one implementation are not intended to be limiting.

The terms "couple" or "couples" as used herein are intended to mean either an indirect or a direct connection. Thus, if a first device couples to a second device, that connection may be through a direct connection or through an indirect mechanical or electrical connection via other devices and connections. Similarly, the term "communicatively coupled" as used herein is intended to mean either a direct or an indirect communication connection. Such connection may be a wired or wireless connection such as, for example, Ethernet or LAN. Such wired and wireless connections are well known to those of ordinary skill in the art and will therefore not be discussed in detail herein. Thus, if a first device communicatively couples to a second device, that connection may be through a direct connection, or through an indirect communication connection via other devices and connections.

Modern petroleum drilling and production operations demand information relating to parameters and conditions downhole. Several methods exist for downhole information collection, including logging while drilling ("LWD") and measurement-while drilling ("MWD"). In LWD, data is typically collected during the drilling process, thereby avoiding any need to remove the drilling assembly to insert a wireline logging tool. LWD consequently allows the driller to make accurate real-time modifications or corrections to optimize performance while minimizing down time. MWD is the term for measuring conditions downhole concerning the movement and location of the drilling assembly while the drilling continues. LWD concentrates more on formation parameter measurement. While distinctions between MWD and LWD may exist, the terms MWD and LWD often are used interchangeably. For the purposes of this disclosure, the term LWD will be used with the understanding that this term encompasses both the collection of formation parameters and the collection of information relating to the movement and position of the drilling assembly.

Figure 1:
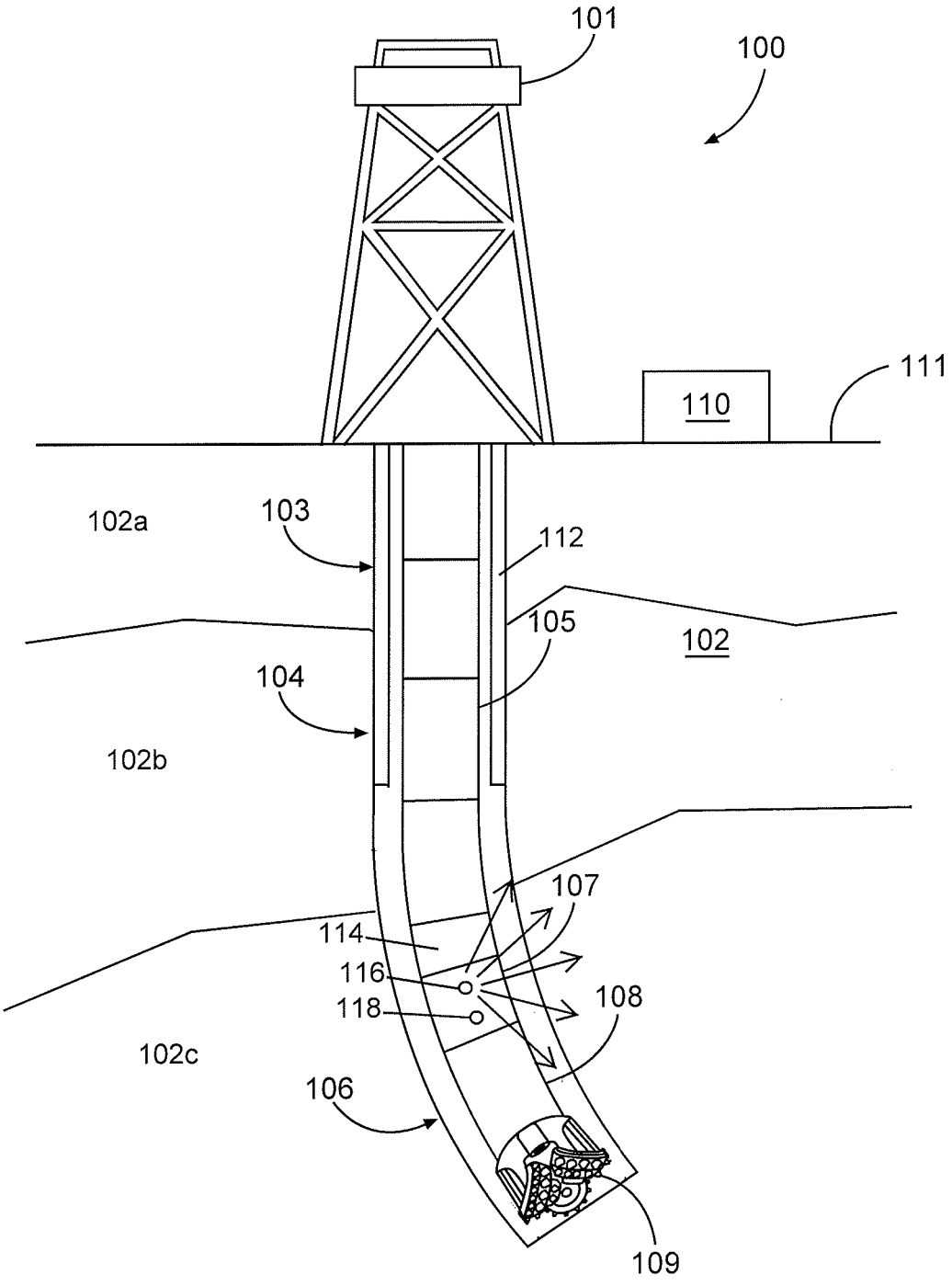
FIG. 1 is a diagram that illustrates an example drilling system, according to aspects of the present disclosure.

FIG. 1 is a diagram illustrating an example drilling system 100, according to aspects of the present disclosure. The drilling system 100 includes rig 101 at the surface 111 and positioned above borehole 103 within a subterranean formation 102 that comprises a plurality of formation strata 102*a-c*. The formation strata 102*a-c* may comprise different types of rock with different characteristics (e.g. porosity, resistivity, permeability, etc.), separated by boundaries. Certain of the formation strata 102*a-c* may contain hydrocarbons, and the drilling system 100 may extend the borehole 103 until that formation strata is contacted.

The drilling system 100 may comprise a drilling assembly 104 coupled to the rig 101. The drilling assembly 104 may comprise a drill string 105 and bottom hole assembly (BHA) 106. The drill string 105 may comprise a plurality of pipe segments that are threadedly connected. In the embodiment shown, the drill string 105 is positioned within a well casing or liner 112. The casing 112 may comprise a metal tubular secured within the borehole 103 using cement, for example, and may function to prevent the borehole 103 from collapsing during the drilling process.

The BHA 106 may comprise a drill bit 109, a steering assembly 108, a LWD/MWD apparatus 107, and telemetry system 114. The steering assembly 108 may control the direction in which the drill bit 109 is pointed and, therefore, the direction in which the borehole 103 will be extended by the drill bit 109. The telemetry system 114 may provide communications between the BHA 106 and a control unit 110 positioned at the surface 111. The control unit 110 may comprise an information handling system with a processor and memory device, and may generate commands to and receive information from the elements of the BHA 106. Additionally, at least one processor may be located within the bottom hole assembly 106 to receive commands from the surface unit 110, to generate communications to the surface unit 110, or to otherwise control the operation of the elements of the BHA 106.

The LWD/MWD apparatus 107 may comprise one or more transmitters 116 and receivers 118, which may be used to take measurements of the surrounding formation 102 and strata 102*a-c* to characterize the formation. The transmitters 116 and receivers 118 may comprise numerous types of transmitters and receives, including coil antenna, electrodes, Hall effect sensors, etc. In certain embodiments, the transmitters 116 and receivers 118 may be combined into transducers incorporated within the LWD/MWD apparatus 107. The transmitters 116 and receivers 118 may generate signals when commanded by the control unit 110 or by a processor within the BHA 106 or the LWD/MWD apparatus 107. Measurements taken using the transmitters 116 and receivers 116 may either be stored within the LWD/MWD apparatus 107 for later retrieval at the surface, or transmitted to the control unit 110 through the telemetry system 114.

According to aspects of the present disclosure, at least one of the transmitters 116 and the receivers 118 may comprise a magnetic monopole. As used herein and will be described below, a magnetic monopole transmitter or receiver may comprise a type of magnetic dipole transmitter or receiver in which the poles are separated such that the effects of the magnetic coupling between the poles on the magnetic fields proximate to the poles are substantially reduced or eliminated. When the magnetic coupling effects are substantially reduced or eliminated, the radiation pattern of the magnetic fields from/to each pole may be substantially radial, thereby pointing to or from the corresponding pole. The radial direction may advantageously be maintained even in the presence of layered formations, such as formation 102. Additionally, as will be described below, because the electromagnetic field radiated by a magnetic monopole are in a radial direction from the monopole, they may be useful for positioning and ranging type of systems, using computationally simpler calculations that are used in other positioning and ranging applications.

In FIG. 1, transmitter 116 comprises a magnetic monopole, and the arrows extending from the transmitter 116 illustrates part of the electromagnetic field radiating from the transmitter 116. As can be seen, the electromagnetic field extends radially outward from the transmitter 116 into the surrounding formation. To the extent there are magnetic elements within the surrounding formation, the electromagnetic field generated by the transmitter 116 may generate a magnetic field within the magnetic elements, which may be measured by the receiver 118. The measurements may then be processed and used in the drilling operations. For example, measurements taken using the magnetic monopole may be used in conjunction with the steering assembly 108 to identify the location of a target borehole (not shown) and cause the borehole 103 to avoid, intersect, or follow the target borehole. Other applications are possible, as will be described below.

Figure 2:
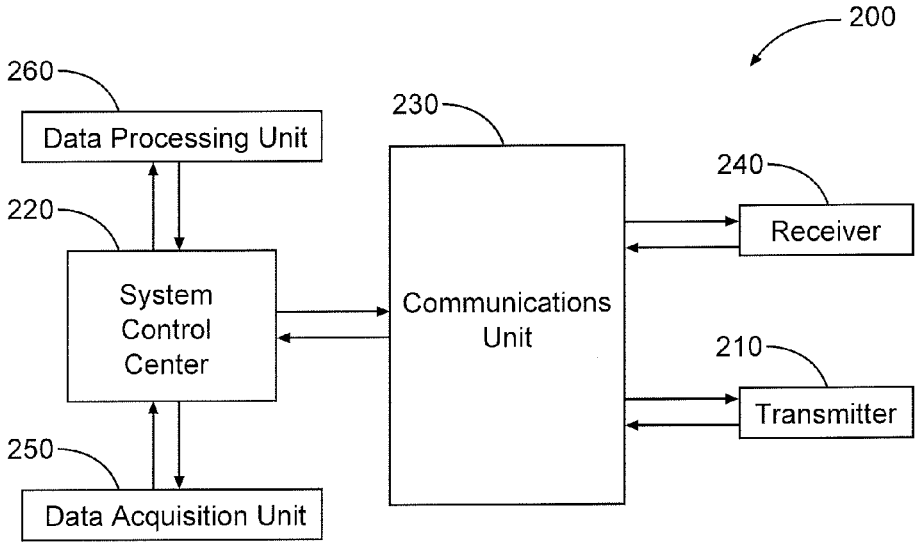
FIG. 2 is a diagram that illustrates an example magnetic monopole logging system, according to aspects of the present disclosure.

FIG. 2 is a diagram of an example measurement/logging system 200, according to aspects of the present disclosure. The system 200 may be used in conjunction with magnetic monopole transmitters and/or receives and may be incorporated, for example, into a LWD/MWD apparatus or a wireline logging tool. The system 200 may comprise a system control center 220 communicable coupled to a communications unit 230. In certain embodiments, the system control center may comprise an information handling system positioned at the surface of a drilling operation and the communications unit 230 may be positioned downhole. The communications unit 230 may also comprise an information handling system, and may comprise parts of a downhole telemetry system and LWD/MWD apparatus or control apparatus within a downhole wireline tool.

In certain embodiments, at least one transmitter 210 and at least one receiver 240 may be communicably coupled to the communications unit 203. At least one of the transmitter 210 and the receiver 240 may comprise a magnetic monopole. The other one of the transmitter 210 and the receiver 240 that is not a magnetic monopole may comprise a galvanic source or a dipole, including a magnetic dipole or an electric dipole. As used herein a galvanic source may comprise a source of direct current electrical energy. In certain embodiments, different quantities and types of transmitters and receivers may be used within the system 200, with some or all operating at different frequencies. For example, in certain embodiments, a magnetic dipole receiver 240 may be used to collect the signal transmitted by a magnetic monopole transmitter 210. Additionally, although system 200 includes both a receiver 240 and a transmitter 210, other systems may include only receivers or only transmitters.

The system control center 220 may issue commands to the transmitter 210 and/or receiver 240 through the communications unit 230 that cause the transmitter 210 and/or receiver 240 to perform certain actions. For example, transmitter 210 may transmit an electromagnetic signal when a "transmit" command is received from the system control center 220 via a communications unit 230. The electromagnetic signal may travels through surrounding formations, as well as through the borehole and the downhole tool, and a part of it may be measured or collected at the receiver 240. Because the transmitted electromagnetic signal interacts with the formation and the borehole as it travels through them, it contains information about the properties of the formation and the borehole.

The received electromagnetic signal may be sent from the receiver 240 to the system control center 220 via the communications unit 230. Once at the system control center 220, the received electromagnetic signal may be transmitted to or processed by a data acquisition unit 250 and a data processing unit 260 communicably coupled to the system control unit 220. For example, the data processing unit 260 may invert the electromagnetic signal collected at the receiver 240 to calculate characteristics of the formation and borehole. In certain embodiments, a visualization unit (not shown) may be connected to the communications unit 230 or the system control center 220 to monitor and intervene in the drilling operations, for example, to stop the drilling process, modify the drilling speed, modify the drilling direction, etc.

In certain embodiments, some or all of the system control center 220, communications unit 230, receiver 240 and transmitter 210 may be located at different physical locations. For example, in certain applications, one or more magnetic monopole transmitters 210 may be positioned at a surface level, at least one receiver 240 may be positioned downhole in a MWD/LWD apparatus, and the communications unit 230 may be located somewhere between the transmitters 210 and receivers 240, such as at the surface above the borehole, near the transmitters 210, or near the receivers 240. As used herein, the surface level may comprise areas that are at, above, or otherwise proximate to the upper surface of a formation. In another embodiments, one or more transmitters 210 may be positioned in a first borehole or well, one or more receivers 240 may be located in another borehole or well, and the communications unit 230 may be positioned at surface level, somewhere between to the two boreholes or wells. Additionally, in certain embodiments, measurement or logging systems may only comprise transmitters or receivers.

FIGS. 3A and 3B are diagrams illustrating the difference between a magnetic monopole element 350 according to aspects of the present disclosure and an existing magnetic dipole element 300. The magnetic dipole element 300 comprises a coil antenna 310 that conducts current in a counterclockwise direction, producing an equivalent magnetic dipole direction shown as arrow 340. The magnetic dipole element 300 may be thought of as a negative (or south) pole 320 and a positive (or north) pole 330 positioned proximate to each other. As can be seen, the magnetic monopole element 350 comprises an elongated coil antenna 360 with a large number of windings that also conducts a time-varying current to produce negative and positive poles 370 and 380. Unlike poles 320 and 330, however, the poles 370 and 380 of the elongated antenna 360 may be separated by a distance such that the effects of the magnetic coupling between the poles 370 and 380 on the magnetic fields in the regions of space near the poles 370 or 380 can be substantially reduced or eliminated. As will be discussed below with reference to FIGS. 4-6, the separation between the poles must be at least a few times larger than the range of use of the magnetic monopole.

The magnetic monopole element 350 may be considered a varying current monopole due to the use of a time-varying current to generate the poles 370 and 380 in the coil antenna 360. Varying current monopoles may also be generated using coil antennas with different shaped windings, such as square loop windings, provided the shape does not close onto itself. Direct-current monopoles are also possible, and may be constructed using an elongated magnet or by magnetizing an elongated elements, such as a casing.

As describe above, magnetic monopoles may generate or receive electromagnetic signals in a substantially radial pattern that is generally free from the effects of a magnetic coupling with the corresponding, opposite pole. Although the magnetic coupling between the poles of a magnetic monopole may still exist, the distance between the poles may make the curvature negligible with respect to a target in the formation near the magnetic monopole. Magnetic dipoles, in contrast, generate or receive electromagnetic signals in a pattern that is curved with respect to the corresponding, opposite pole due to the proximity of the poles. To illustrate the differences, FIGS. 4-5 are diagrams showing the radiation patterns of magnetic dipole configurations, while FIG. 6 includes diagrams illustrating the radiation patterns of an example magnetic monopole antenna configuration.

In particular, FIGS. 4A-C illustrate the magnetic field direction and field strength contour lines for an infinitesimal magnetic dipole oriented in z-direction. In FIG. 4A, a field direction for the imaginary part of the magnetic field is shown on a grid in the x-z plane in a homogeneous formation of conductivity $\sigma$=0.05 S/m for a magnetic dipole. The magnetic dipole is oriented in the z-direction in the Cartesian coordinate system, and the frequency is 10 kHz. The relative permeability and permittivity of the formation is selected to be equal to unity. As can be seen, the magnetic field forms a closed loop starting from the positive pole and ending at the negative pole (the poles are illustrated as circles in the center of the diagram), with the lines of radiation having a curvature corresponding to the distance between the poles.

Notably, FIG. 4A is not a true vector representation of the field because it contains the direction information but no information about the field's strength. This was done to better illustrate the field direction in places where the field strength is low. Further, because the real part of the magnetic field has a very low amplitude at low frequencies, the imaginary part was plotted in these figures to demonstrate the field direction. FIGS. 4B and 4C show the contour plots of normalized strength of the x- and z-components of the H-field with respect to position, respectively. As can be seen, the strength of the magnetics field decays with respect to the distance from the transmitter.

FIGS. 5A-C illustrate the magnetic field direction and field strength contour lines for a finite length magnetic dipole, corresponding to a coil with a finite wire thickness and multiple windings of the turns. For the purposes of this depiction, separation between the two ends of the coil (and thus the two poles of the dipole) is assumed to be equal to L=5 cm. The frequency of operation is still 10 kHz, and the formation properties are the same as in FIGS. 4A-C. This configuration may be modeled by integrating the fields produced by magnetic dipoles over the tool's length.

FIG. 5A shows the magnetic field direction for this case. Notably, although in these plots some separation between the fields of the poles can be seen, and the fields become more radial in close proximity to the poles, the poles are still not isolated and the magnetic fields show the coupling effects from the poles in the form of curvature. FIGS. 5B and 5C show the corresponding contour plots of the normalized field components in the x- and z-direction, respectively. As can be seen, although the strength of the magnetics field still decays with respect to the distance from the transmitter, the magnetic field extends farther when the poles are separated.

FIGS. 6A-C illustrate the magnetic field direction and field strength contour lines for a magnetic monopole, according to aspects of the present disclosure. In the embodiment shown, the transmitter and receiver are separated by a distance of L=10 m. The field direction close to the positive pole is shown in FIG. 6A, and it can be seen to be almost completely radial in direction from the pole with very little coupling between the two poles. Thus, magnetic fields in this region are effectively that of a magnetic monopole. FIGS. 6B and 6C illustrate contour lines for the normalized strength of the magnetic dipole in x- and z-directions, and also illustrate that the coupling between the positive and negative poles has been almost completely eliminated.

FIGS. 6A-C illustrate that fields radiated by a monopole tool are in a radial direction by applying an empirical approach where one of the poles of a magnetic dipole is isolated using an integration of infinitesimal magnetic dipoles over a long distance. Alternatively, using the duality of the magnetic monopole with an electric charge, fields due to an isolated magnetic pole can be written directly as:

$$\vec{H}(\vec{r}) = \frac{q_m}{4\pi\mu}\frac{\vec{r}}{r^3} \qquad \text{EQUATION 1}$$

where $\vec{r}$ is the position vector with the hypothetical magnetic charge $q_m$ assumed to be at the origin; $\vec{H}$ is the magnetic field vector; and $\mu$ is the permeability of the medium. Magnetostatic conditions are assumed in writing Equation 1. In electrodynamic construction of the magnetic monopole, the term in Equation 1 can be considered as the amplitude of the magnetic field phasor, except that the distance calculations will be valid only so long as the frequency is low enough for near field approximation.

Based on the known fields of a single magnetic monopole (e.g., the fields described using equation 1), the fields due to an arbitrary distribution of magnetic monopoles may be determined, for example, using the superposition principle. In an example case, FIG. 7 illustrates a magnetic dipole modeled as a system of two isolated magnetic poles. Using derivations performed for an electric dipole in combination with the duality principle, the magnetic fields of the magnetic dipole shown in FIG. 7 may be written as:

$$\vec{H}(\vec{r}) = \frac{q_m}{4\pi\mu}\left\{\frac{\vec{r}-\vec{d}/2}{\left|\vec{r}-\vec{d}/2\right|^3} - \frac{\vec{r}+\vec{d}/2}{\left|\vec{r}+\vec{d}/2\right|^3}\right\} \qquad \text{EQUATION 2}$$

Equation 2 may be rewritten as Equation 3, below, when the observation point is much further than the spacing between the poles.

$$\left|\vec{r}-\vec{d}/2\right|^3 \approx r^{-3}\left[1+\frac{3\vec{r}\cdot\vec{d}}{2r^2}\right]; \qquad \text{EQUATION 3}$$

$$\left|\vec{r}+\vec{d}/2\right|^3 \approx r^{-3}\left[1-\frac{3\vec{r}\cdot\vec{d}}{2r^2}\right];$$

$$\Rightarrow \vec{H}(\vec{r}) \approx \frac{q_m}{4\pi\mu r^3}\left\{\frac{3\vec{r}\cdot\vec{d}}{2r^2}\vec{r}-\vec{d}\right\}$$

As illustrated in Equation 3, the strength of the fields increases in proportion to the spacing between the poles. Thus, the distance between the poles of the magnetic dipole with respect to the creation of a magnetic monopole not only determine how closely it resembles a real magnetic monopole, but also affect the strength of the radiated fields as well. For downhole applications, where directionality and field strength are important due to the size of the areas to be measured, a magnetic monopole with high field strength and directionality may be created by locating one end of a coil winding at surface level and another end downhole.

FIGS. 8A-B illustrate the voltage and frequency responses caused by a magnetic monopole antenna compared to a magnetic dipole antenna, according to aspects of the present disclosure. In particular, FIG. 8A shows the absolute value of the induced voltage on a coil receiver 10 ft away from a magnetic monopole comprising two z-oriented poles separated by a distance of L=10 m, and from a magnetic dipole with a finite physical length of 5 cm and a radius of 2.375 inches. The induced voltage from the monopole is shown as a dashed line, and the induced voltage from the magnetic dipole is shown as a solid line. FIG. 8B shows the phase angles of the induced voltages on the coils using the same dashed and solid line indicators. As can be seen, the monopole may induce a larger voltage onto the coil receiver due to the higher field strength of the monopole, but the frequency responses of the receiver to the magnetic monopole and magnetic dipole antennas are similar.

According to aspects of the present disclosure, magnetic monopole transmitters and receivers may be positioned and used in various types of tools and configurations to perform many different types of measurements and operations related to a hydrocarbon recovery operations. One example operation is the determination of the position of a downhole object using the radial magnetic field of the magnetic monopole to determine a relative position vector between a transmitter and a receiver. In certain embodiments, the position may comprise the absolute position of a downhole object, such as a BHA or drill bit, or the position with respect to the surface. In certain embodiments, the position may comprise the relative position of the downhole object, such as a BHA, drill bit, casings, etc., with respect to another downhole element.

In one embodiment, one or more monopole transmitters may be placed at a surface level of a drilling site at known locations. As used herein, a monopole transmitter positioned at the surface level may include monopole transmitters mounted on stands above surface, laid on the surface, or buried proximate to the surface. In addition to the one or more monopole transmitters placed at the surface, at least one receiver may be located downhole to measure and calculate the relative position vector between the one or more surface monopole transmitters and the downhole receiver. In certain embodiments, the receiver may be coupled to a downhole element, such as a LWD/MWD apparatus or a wireline tool. Because the position of the surface level transmitters is known, the position of the receiver may be determined using the measured relative vectors between the transmitters and the receivers. In this way, accurate positioning calculations may be made even in environments containing formation layers with magnetic properties. In certain embodiments, the position can be tracked over time, allowing an operator to determine, for example, if a well is being drilled in the correct location and along the planned path of the well.

In certain embodiments, the vector relationship between a monopole transmitter and a receiver may be written as:

$$\vec{r}-\hat{n}^i d^i=\vec{r}^{\,i} \qquad \text{EQUATION 4}$$

where, $\vec{r}$ is the position vector of the receiver, $\vec{r}^{\,i}$ is the location vector of $i^{th}$ transmitter, $\hat{n}^i$ is the unit vector in the direction of the magnetic field due to $i^{th}$ transmitter at the receiver and $d^i$ is the distance between $i^{th}$ transmitter and the receiver. In the case where there are T such transmitters (i.e. i=0, . . . , T−1) used, the vectors may be separated into components of Cartesian coordinates to obtain the following a matrix equation:

EQUATION 5

$$\begin{bmatrix} 1 & 0 & 0 & -n_x^0 & 0 & \dots & 0 \\ 0 & 1 & 0 & -n_y^0 & 0 & \dots & 0 \\ 0 & 0 & 1 & -n_z^0 & 0 & \dots & 0 \\ 1 & 0 & 0 & 0 & -n_x^1 & \dots & 0 \\ \vdots & \vdots & \vdots & \vdots & \vdots & \vdots & \vdots \\ 0 & 0 & 1 & 0 & 0 & \dots & -n_z^{T-1} \end{bmatrix} \begin{bmatrix} x \\ y \\ z \\ d^0 \\ d^1 \\ \vdots \\ d^{T-1} \end{bmatrix} = \begin{bmatrix} x^0 \\ y^0 \\ z^0 \\ x^1 \\ \vdots \\ z^{T-1} \end{bmatrix}$$

In matrix Equation 5, it is assumed that the transmitter locations and the field direction at the receivers are exactly known, as is the receiver's relative orientation with respect to the global reference coordinate system, which can be obtained a gravitometer and an inclinometer tool. $(n_x^i, n_y^i, n_z^i)$ represents the x, y, and z components of the unit vector $\hat{n}^i$. The receiver position can be solved by, for example, multiplying both sides of the expression with the pseudo-inverse of the matrix containing the unit vectors.

The equations above assume that the receiver is able to resolve the exact direction of the field vectors, which may be accomplished by use of a tri-axial receiver that may detect field information in three directions, such as for example in the directions of the x-, y-, and z-axis. Positioning may still be accomplished if the receiver is biaxial—i.e., if the receiver may detect field information in two directions, such as for example an x-axis and y-axis. FIG. 9 illustrates a magnetic field measured by a biaxial receiver, where the field direction due to a monopole transmitter $T^i$ at a receiver R is shown. For a biaxial receiver, the projection of a field vector in the plane of the receivers may be found, which is shown as vector $\vec{u}$. An arbitrary vector that is orthogonal to the plane formed by the receivers (shown as $\vec{v}$) can also be defined. Then, vectors $\vec{u}$ and $\vec{v}$ and transmitter location $(x^i, y^i, z^i)$ may be used to define a plane on which receiver location (x, y, z) also lies. In a parametrical equation form, this plane may be defined as:

$$\vec{r}-a^i\vec{u}^i-b^i\vec{v}^i=\vec{r}^{\,i} \qquad \text{EQUATION 6}$$

Variables $a^i$ and $b^i$ in Equation 6 may be real numbers with a different value for each point on the plane. If position vector $\vec{r}$ is not an arbitrary point on the plane but instead denotes the receiver position specifically, $a^1$ and $b^i$ become constant unknowns whose values may be solved to determine $\vec{r}$. In certain embodiments, if there are at least three transmitters and the planes defined by the transmitter and the receiver locations are independent, the receiver position can be inverted. An example matrix equation that can be solved to obtain the receiver location (x, y, z) comprises:

EQUATION 7

$$\begin{bmatrix} 1 & 0 & 0 & -u_x^0 & -v_x^0 & \dots & 0 \\ 0 & 1 & 0 & -u_y^0 & -v_y^0 & \dots & 0 \\ 0 & 0 & 1 & -u_z^0 & -v_z^0 & \dots & 0 \\ 1 & 0 & 0 & 0 & 0 & \dots & 0 \\ \vdots & \vdots & \vdots & \vdots & \vdots & \vdots & \vdots \\ 0 & 0 & 1 & 0 & 0 & \dots & -v_z^{T-1} \end{bmatrix} \begin{bmatrix} x \\ y \\ z \\ a^0 \\ b^0 \\ \vdots \\ b^{T-1} \end{bmatrix} = \begin{bmatrix} x^0 \\ y^0 \\ z^0 \\ x^1 \\ \vdots \\ z^{T-1} \end{bmatrix}$$

FIG. 10 is a diagram illustrating an example positioning system, according to aspects of the present disclosure. The positioning system comprises three monopole transmitters $T_0$, $T_1$, and $T_2$ respectively located on a surface at (2000, −1000, 0), (1000, 0, 0) and (3000, 0, 0) meters, where (x, y, z) is a vector whose components represents the position in the corresponding axis of the Cartesian coordinates. A downhole receiver R traces a path—such as a well bore—that can be parameterized as (x, y, z)=(2000·cos(θ)−17600, −700, −20000·sin(θ)) meters where θ is varied between 0° and 30° in 1° steps. Receiver R may comprise a tri-axial receiver capable of measuring all components of the magnetic field, whose relative orientation with respect to the reference coordinate system is known.

FIGS. 11A-F illustrate the results of an example positioning simulation using the positioning system shown in FIG. 10 and synthetic data, where the inverted position is obtained using a Monte Carlo simulation. Notably, because the receiver R is a tri-axial receiver, Equation 5 has been used to determine the position of the receiver R. The basic field model for the monopole transmitters described in Equation 1 was used for the simulation, with the monopole strength, $$\frac{q_m}{4\pi\mu},$$

assumed to be unity and properties of the formation not taken into account (i.e., the formation is assumed to be a homogeneous, isotropic medium with no loss). When fields at the receiver position were calculated, a combination of multiplicative and additive noises was added to take into account all the irregularities and errors in the measurement, written as:

$$\vec{H}=\vec{H}_{ideal}\cdot(1+u(-0.5,0.5)/\mathrm{SNR})+2\cdot10^{-10}\cdot u(-0.5,0.5) \quad \text{EQUATION 8}$$

where SNR is a definition of signal to noise ratio (or, in this case, signal to multiplicative noise ratio since additive noise distribution is assumed to be independent of the measured field) and is taken to be equal to 30 in the simulations. The function u(−0.5,0.5) represents a random number taken from a uniform distribution between −0.5 and 0.5.

Figure 11A:
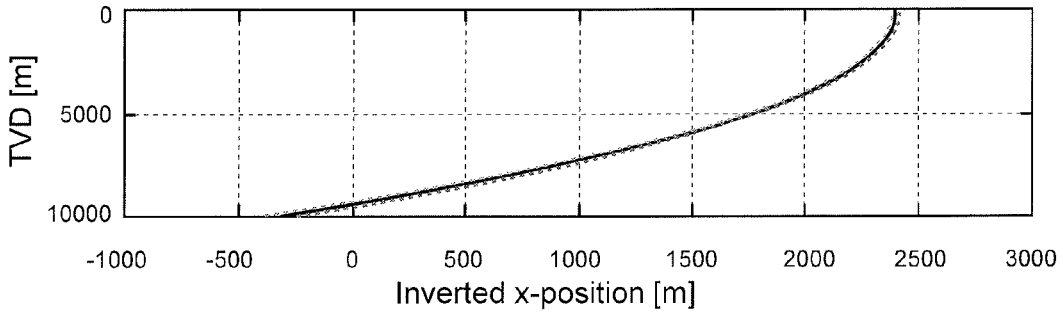
Figure 11B:
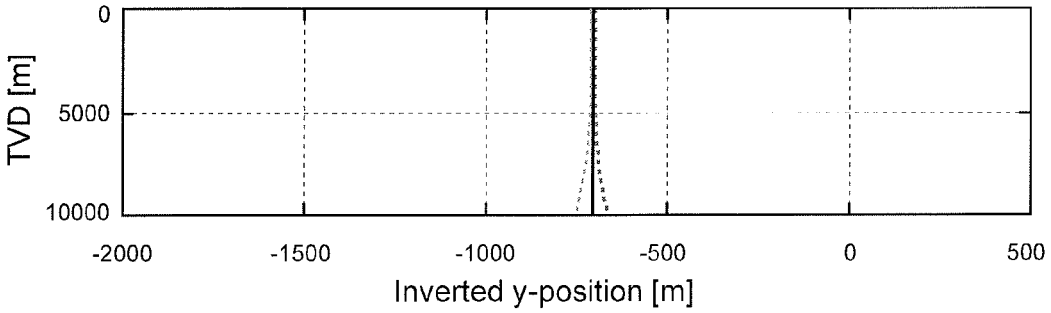
Figure 11C:
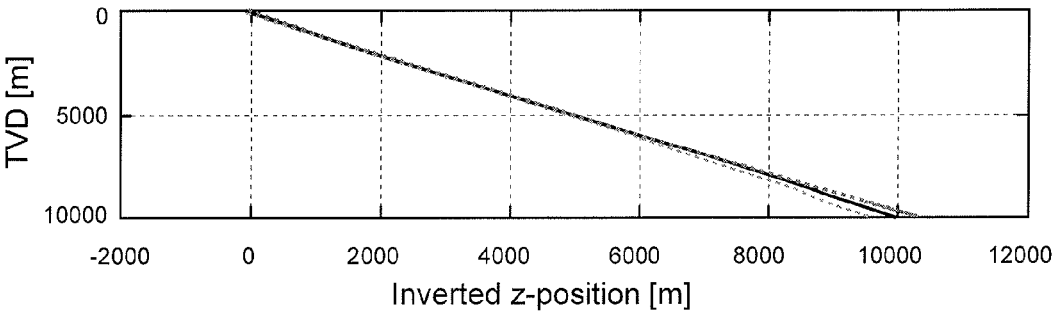
Figure 11D:
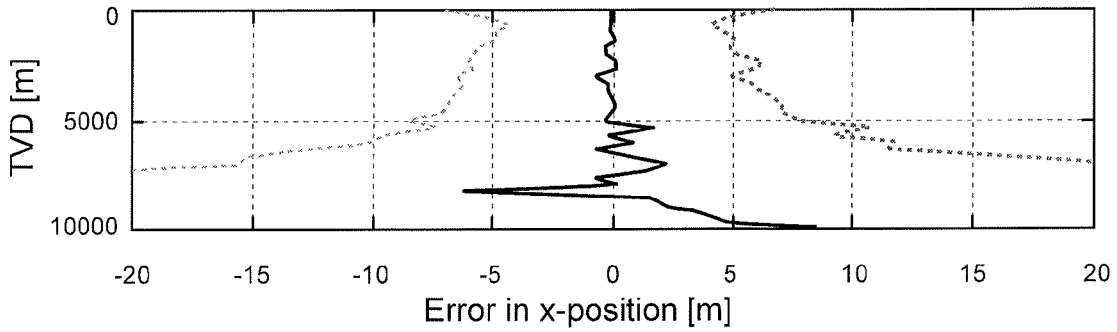
Figure 11E:
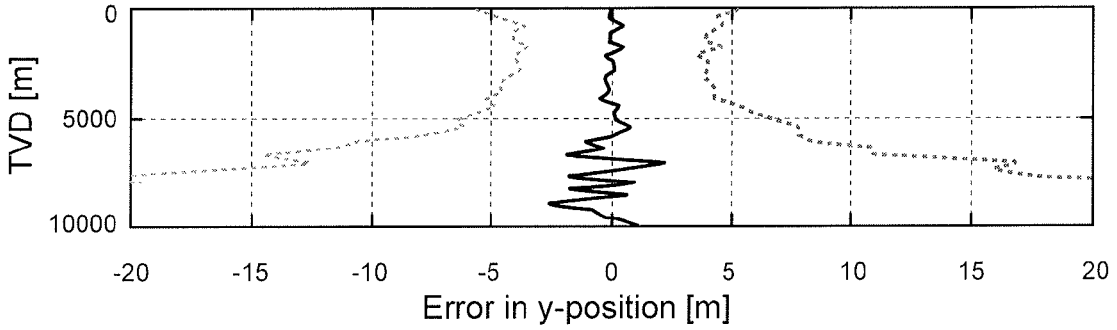
Figure 11F:
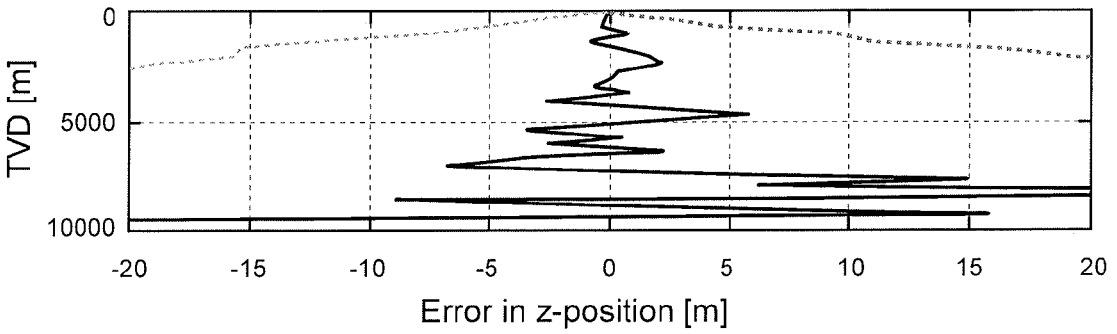

In FIGS. 11A-F, the position of the receiver is calculated as the parameter θ is changed between 0° and 30° in 1° steps. At each step, the inversion was repeated 100 times (with different random noise added to the ideal noiseless data), and the mean value and the standard deviations of the receiver position was found. The values are plotted in FIGS. 11A-C as a function of true vertical depth (TVD), while the corresponding errors with respect to the true receiver position are shown in FIGS. 11D-F. In these figures, the darker line represents the mean value and the lighter line on either side represents the mean plus and minus one standard deviation of the inverted results. The real receiver location is also shown as a solid line on FIGS. 11A-C, demonstrating that fairly accurate determination of position is possible using a very simple inversion process.

Based on the simulation results in FIGS. 11A-F, the positioning system described above may produce an accurate determination of the position of the receiver R relative to the transmitters. Notably, the results may become less accurate as the receiver moves downward because the field amplitude gets smaller and the effect of additive noise becomes stronger. In the embodiment shown, error in the z-position is larger than the other components because the transmitters are all assumed to be on the surface (z=0 plane), reducing the resolution in the z-direction. Other transmitter orientations can be used, however, to increase the range and accuracy in the z-direction and in other directions.

In addition to determining the position of a downhole element using a magnetic monopole, magnetic monopoles also may be used to determine the range between a transmitter and a receiver. Notably, if the position of a receiver relative to a transmitter is known, then its range may be easily calculated. However, the range to a downhole element may also be determined using magnetic monopoles if the relative position of the downhole element is not known. It may be useful to determine the distance between downhole elements even if their exact positions are not known. For example, in certain instances, pressure containment may be lost in a downhole well (the target well) and a secondary well (the relief well) may be drilled to intersect the target well to contain the pressure. Distance measurements may be used to determine the distance between the relief well and the target well to ensure that the relief well accurately intersects the target well.

In certain embodiments, a distance or range calculation between a transmitter and a receiver may be calculated using a field equation similar to Equation (1), with a component (or projection) of the field $\vec{H}(\vec{r})$ in an arbitrary direction $\hat{c}$ written as:

EQUATION 9

$$H^c(\vec{r}) = \frac{q_m}{4\pi\mu}\frac{\vec{r}\cdot\hat{c}}{r^3}$$

The range between a transmitter and a receiver may be determined using Equation 10 by taking a derivative of $H^c$ in Equation 9 with respect to a Cartesian direction, in this case j:

EQUATION 10

$$\frac{\partial H^c(\vec{r})}{\partial j} = \frac{\partial}{\partial j}\left(\frac{q_m}{4\pi\mu}\frac{\vec{r}\cdot\vec{c}}{r^3}\right) = \frac{\partial}{\partial j}\left(\frac{q_m}{4\pi\mu}\frac{jc_j + kc_k + lc_l}{(j^2+k^2+l^2)^{\frac{3}{2}}}\right)$$

In practice, the derivative operation of Equation 10 may correspond to a gradient measurement of the magnetic field that may be performed using two receivers in close proximity to each other, separated in the derivative direction, j. Specifically, the two receivers may take first and second measurements of the magnetic field, and the first and second measurements may be subtracted to perform the derivative operation or calculate the gradient measurement of the magnetic field.

FIG. 12 illustrates example receivers $R_1$ and $R_2$ for the derivative operation, arranged in close proximity in the j direction. The result of the derivative operation in Equation 10 can be written as:

EQUATION 11

$$\frac{\partial H^c(\vec{r})}{\partial j} = \frac{q_m}{4\pi\mu}\left(\frac{c_j(j^2+k^2+l^2)^{\frac{3}{2}} - 3j(j^2+k^2+l^2)^{\frac{1}{2}}jc_j + kc_k + lc_l}{(jc_j + kc_k + lc_l)^3}\right) = \frac{q_m}{4\pi\mu}\left(\frac{\hat{c}\cdot\hat{j}}{r^3} - \frac{3j}{r^5}(\vec{r}\cdot\hat{c})\right)$$

Assuming c and j are orthogonal to each other, such that $\hat{c}\cdot\hat{j}=0$, then the ratio of $H^c$ to its derivative at $\vec{r}$ becomes:

EQUATION 12

$$\frac{H^c(\vec{r})}{\left(\frac{\partial H^c(\vec{r})}{\partial j}\right)} = -\frac{r^2}{3j}\frac{r}{3(\hat{r}\cdot\hat{j})} \Rightarrow r = -3(\hat{r}\cdot\hat{j})\frac{H^c(\vec{r})}{\left(\frac{\partial H^c(\vec{r})}{\partial j}\right)}$$

Accordingly, if $\vec{r}\cdot\hat{j}$ is known, the distance from the transmitter to the receiver may be obtained by calculating the ratio of the field to its derivative or gradient at that position. If two receivers in close proximity (such as $R_1$ and $R_2$ in FIG. 12) are used to find the derivative or gradient, the average value of the field at these two receivers may be used to find the field itself.

In certain embodiments, the positioning system shown in FIG. 10 may be adapted to a ranging positioning sensor by adding additional downhole receivers to calculate the field derivatives downhole. FIGS. 13A-F illustrate example ranging simulation results using the system described above and synthetic data. The ranges were calculated using two receivers located at (x, y, z±50 m) applying Equation 12, with the simulated range shown as a dashed line, the true range shown as a solid line, the derivative direction (j) taken as the z-direction, and (x, y, z) is the point whose range is found. Notably, the range with respect to all three transmitters was calculated separately for x- and y-components (components orthogonal to the derivative direction).

FIGS. 13A-F demonstrate that accurate ranges may be calculated at various receiver positions relative to the transmitters, with the range being accurate up to a distance of approximately 3000 m using the disclosed method and the chosen parameter set. In most cases, a single derivative using two receivers may be enough to calculate the range, but additional receivers may improve the accuracy. However, if the two receivers lie at the same radial distance from a magnetic monopole transmitter, field amplitude at these two receivers may be the same, preventing calculation of a derivative value. To prevent such blind spots, a derivative may be found in all three orthogonal directions in a practical implementation.

In certain embodiments, the general position and/or range calculations using magnetic monopoles described above may be used is specific downhole applications, such as position marking on a target well. As described above, in certain instances, such as in a blowout, it may be necessary to intersect a first well, called a target well, with a second well, called a relief well. The second well may be drilled for the purpose of intersecting the target well, for example, to relieve pressure from the blowout well. Contacting the target well with the relief well typically requires multiple downhole measurements to identify the precise location of the target well and the point on the target well where the relief well should intersect the target well. Quickly and accurately intersecting the target well may be important to the success of the operation.

FIG. 14 is a diagram of an example drilling system utilizing magnetic monopoles, according to aspects of the present disclosure. In the embodiment shown, a target well 1410 is disposed within a formation and a relief well 1430 is being drilled to intersect the target well 1410. In the embodiment shown, one or more magnetic monopole transmitters 1420 may be within the target well 1410 proximate to a casing 1415 at a position in which the relief well 1430 is to intersect the target well 1410. A drilling assembly (not shown) within the target well 1430 may include at least one receiver to measure the radial magnetic fields generated by the monopole transmitters 1420.

One or more control systems (not shown) may be coupled to the transmitters 1420 and the receivers to cause the transmitters 1420 to generate the radial magnetic fields and the receivers to measurement the magnetic fields. At least one the distance from the transmitters 1420 to the receivers or the relative position of the transmitters 1420 to the receivers may be calculated at the control systems. Using the range or position calculations, the trajectory of the relief well 1430 may be recalculated and adjusted to ensure that the relief well 1430 intersects the target well 1410 at the position indicated by the transmitters 1430. Without the magnetic monopole transmitters 1420, the relief well 1430 may detect the casing 1415 of the well 1410 that needs to be intersected but will not be able to estimate the exact point on the well 1410 where the intersection should occur.

Another example drilling application using magnetic monopoles and the corresponding range and position calculations described above comprises a SAGD application. In SAGD systems, a second well is drilled parallel to an existing horizontal well in a desired region of space, and high pressure steam may be injected into the upper wellbore to heat the oil and reduce its viscosity, causing the heated oil to drain into the lower wellbore, where it may be pumped out. FIG. 15 illustrates one embodiment of a SAGD system utilizing magnetic monopoles. As shown in the embodiment of FIG. 15, magnetic monopole transmitters 1520 may be installed on an existing first horizontal well 1510 proximate to well casing 1515. A second well 1530 may be drilled to follow or mirror the first well 1510 at a pre-determined distance. A drilling assembly (not shown) within the second well 1530 may comprise at least one receiver which measures the radial magnetic fields generated by the transmitters 1520. The measurements may be used to determine the range and or relative position of the receivers with respect to the transmitters 1520, which can in turn be used to adjust the trajectory of the second well 1530.

Magnetic monopoles may be used for other applications as well. For example, magnetic monopoles may be used to ensure that multiple wells within the same formation do not intersect, using the radial magnetic fields generated by the magnetic monopoles to calculate the range between the wells to ensure that they maintain a given certain distance from each other. Additionally, magnetic monopoles may be used with typical wireline or LWD/MWD tools to increase the range of the resulting measurements due to the stronger magnetic fields generated by the magnetic monopole. Likewise, in all the applications described above, the positions and relative operations of the receivers and the transmitters may be switched.

According to aspects of the present disclosure, an example method for downhole operations using a magnetic monopole may include positioning at least one of a transmitter and a receiver within a first borehole. At least one of the transmitter and the receiver may be a magnetic monopole. The transmitter may generate a first magnetic field, and the receiver may measure a signal corresponding to the first magnetic field. A control unit communicably coupled to the receiver may determine at least one characteristic using the received signal.

In certain embodiments, the transmitter and receiver may be located on the same tool, such as a wireline tool or a LWD/MWD apparatus, that may be positioned within the first borehole. The receiver may measure secondary magnetic fields generated by the primary magnetic field, and the control unit may determine formation characteristics, such as permittivity, resistivity, etc., based on the secondary magnetic field.

In certain embodiments, either the transmitter or the receiver may be positioned at surface level above the first borehole or within a second borehole, and a relative position and/or distance between the two may be determined. For example, the receiver may be positioned within the first borehole on a logging-while-drilling or measurement-while drilling tool and the transmitter may be one of a plurality of transmitters located within the second borehole. In certain embodiments, the second borehole may comprise a target well and the plurality of transmitters may be positioned at an intersection point on the target well. In certain embodiments, the second borehole may be a horizontal well, such as in a SAGD application, and the plurality of transmitters may be positioned along the length of the horizontal wellbore. Distance and/or position calculations may be made with respect to the plurality of transmitters and receiver, and the calculations may be used to determine a drilling trajectory of the first borehole.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces. Additionally, the terms "couple", "coupled", or "coupling" include direct or indirect coupling through intermediary structures or devices.

What is claimed is:

1. A method for downhole measurements, comprising:

positioning at least one of a transmitter and a receiver within a first borehole, wherein at least one of the transmitter and the receiver comprises a magnetic monopole, wherein a first pole and a second pole of the at least one of the transmitter and the receiver are separated by a distance such that effects of magnetic coupling between the first pole and the second pole on magnetic fields proximate to the first pole and the second pole are reduced or eliminated such that a radiation pattern of magnetic fields from and to at least one pole of the first pole or the second pole is substantially radial;

generating a first magnetic field at the transmitter;

measuring at the receiver a signal corresponding to the first magnetic field; and determining at least one downhole characteristic using the received signal at a control unit communicably coupled to the receiver.

2. The method of claim 1, wherein positioning at least one of the transmitter and the receiver within the first borehole comprises one of positioning the transmitter and the receiver within the first borehole on a wireline tool; and positioning the transmitter and the receiver within the first borehole on a logging-while-drilling or measurement-while drilling tool.

3. The method of claim 1, wherein positioning at least one of the transmitter and the receiver within the first borehole comprises permanently positioning the transmitter or the receiver on a casing.

4. The method of claim 1, wherein positioning at least one of a transmitter and a receiver within a first borehole comprises one of positioning the transmitter in a first borehole and positioning the receiver either at a surface level or within a second borehole or positioning the receiver in a first borehole and positioning the transmitter either at a surface level or within a second borehole.

5. The method of claim 1, wherein positioning at least one of the transmitter and the receiver within the first borehole comprises positioning the receiver within the first borehole on a logging-while-drilling or measurement-while drilling tool; and positioning the transmitter within a second borehole, wherein positioning the transmitter comprises positioning a plurality of transmitters within the second borehole.

6. The method of claim 5, wherein positioning the plurality of transmitters within the second borehole comprises positioning the plurality of transmitters proximate to an intersection point in a target borehole.

7. The method of claim 5, wherein positioning the plurality of transmitters within the second borehole comprises positioning the plurality of transmitters along the length of a horizontal borehole.

8. The method of claim 5, wherein determining at least one downhole characteristic using the received signal comprises determining at least one of a distance between the plurality of transmitters and the receiver, and a position of the receiver relative to the plurality of transmitters.

9. The method of claim 8, further comprising altering a drilling trajectory based, at least in part, on the downhole characteristic.

10. The method of claim 1, wherein the transmitter is permanently positioned in the first borehole.

11. The method of claim 1, wherein determining at least one downhole characteristic using the received signal comprises determining at least one of a distance between the transmitter and the receiver, and a position of the receiver relative to the transmitter.

12. The method of claim 11, further comprising performing a first measurement and a second measurement of the first magnetic field, wherein determining the distance between the transmitter and the receiver comprises calculating a gradient measurement of the magnetic field using the first measurement and the second measurement.

13. The method of claim 12, wherein calculating the gradient measurement comprises calculating a difference between the first measurement and the second measurement.

14. The method of claim 12, wherein the second measurement is a gradient measurement.

15. The method of claim 12, wherein determining the distance between the transmitter and the receiver comprises determining a ratio of the first measurement to the gradient measurement.

16. The method of claim 11, wherein the position is calculated at least in part from a direction of the first magnetic field.

17. The method of claim 11, wherein the position is calculated only by using a direction of the first magnetic field.

18. An apparatus for downhole measurements, comprising:

a transmitter that generates a magnetic field; and a receiver that detects the magnetic field generated by the transmitter, wherein at least one of the transmitter and the receiver comprises a magnetic monopole, wherein a first pole and a second pole of the at least one of the transmitter and the receiver are separated by a distance such that effects of magnetic coupling between the first pole and the second pole on magnetic fields proximate to the first pole and the second pole are reduced or eliminated such that a radiation pattern of magnetic fields from and to at least one pole of the both poles is substantially radial.

19. The apparatus of claim 18, further comprising:

a control unit communicably coupled to the transmitter and the receiver, the control unit comprising a set of instructions that, when executed by a processor of the control unit, cause the processor to generate a first command to the transmitter to generate a first magnetic field; and generate a second command to the receiver to measure a signal corresponding to the first magnetic field; and determine at least one downhole characteristic using the received signal.

20. The apparatus of claim 19, wherein the signal corresponding to the first magnetic field comprises a secondary magnetic field generated by the first magnetic field; and the at least one downhole characteristic comprises at least one characteristic of a formation surrounding a borehole.

21. The apparatus of claim 19, wherein the at least one downhole characteristic comprises at least one of a distance between the transmitter and the receiver, and a position of the receiver relative to the transmitter.

22. The apparatus of claim 18, wherein the magnetic monopole is one of a varying-current monopole and a direct-current monopole.

23. The apparatus of claim 22, wherein the varying-current monopole comprises an elongated coil.

24. The apparatus of claim 22, wherein the direct-current monopole comprises an elongated magnet.

25. The apparatus of claim 23, wherein the other one of the receiver or the transmitter is a galvanic source or dipole.

26. The apparatus of claim 25, wherein the other one of the receiver or the transmitter is an electric dipole.

27. The apparatus of claim 18, wherein the transmitter and the receiver are coupled to one of a wireline tool and a logging-while-drilling or measurement-while drilling tool.

28. The apparatus of claim 18, wherein one of the transmitter and the receiver is located within a first borehole; and the other of the transmitter and the receiver is located either at a surface level or within a second borehole.

29. The apparatus of claim 28, wherein the receiver is positioned within the first borehole on a logging-while-drilling or measurement-while drilling tool; and the transmitter comprises a plurality of transmitters positioned within the second borehole.

30. The apparatus of claim 29, wherein the second borehole comprises a target borehole; and the plurality of transmitters are positioned proximate to an intersection point in the target borehole.

31. The apparatus of claim 29, wherein the second borehole comprises a horizontal borehole; and the plurality of transmitters are positioned along the length of the horizontal borehole.

32. The apparatus of claim 29, wherein the at least one downhole characteristic comprises at least one of a distance between the plurality of transmitters and the receiver, and a position of the receiver relative to the plurality of transmitters.

* * * * *